US006612906B2

(12) United States Patent
Benderly

(10) Patent No.: US 6,612,906 B2
(45) Date of Patent: Sep. 2, 2003

(54) VIBRATORY MATERIAL REMOVAL SYSTEM AND METHOD

(76) Inventor: David Benderly, 555 Main St., New York, NY (US) 10044

( * ) Notice: Subject to any disclaimer, the term of this patent is extended or adjusted under 35 U.S.C. 154(b) by 103 days.

(21) Appl. No.: 10/035,715

(22) Filed: Oct. 22, 2001

(65) Prior Publication Data

US 2003/0077980 A1 Apr. 24, 2003

(51) Int. Cl.[7] ..... B24C 1/00

(52) U.S. Cl. ..... 451/29; 451/30; 451/31; 451/36; 451/165

(58) Field of Search ..... 451/29, 36, 38–40, 451/115, 445, 30, 31; 427/259; 156/625

(56) References Cited

U.S. PATENT DOCUMENTS

| | | | | | |
|---|---|---|---|---|---|
| 2,034,308 | A | * | 3/1936 | Morgan | 428/173 |
| 2,850,854 | A | * | 9/1958 | Levy | 451/36 |
| 4,093,754 | A | * | 6/1978 | Parsons | 427/259 |
| 5,197,234 | A | * | 3/1993 | Gillenwater | 451/29 |
| 5,303,510 | A | * | 4/1994 | Calkins | 451/36 |
| 5,307,594 | A | * | 5/1994 | Panchison | 451/29 |
| 5,967,880 | A | * | 10/1999 | Major | 451/36 |
| 6,422,920 | B1 | * | 7/2002 | Bouten et al. | 451/29 |

* cited by examiner

*Primary Examiner*—George Nguyen
(74) *Attorney, Agent, or Firm*—Kirschstein, et al.

(57) ABSTRACT

Material is removed from objects to be marked or machined by applying apertured masks having cutouts arranged in a pattern on the objects, applying a liquid mixture of abrasive particles over the masks, and then ultrasonically vibrating the mixture to propel the abrasive particles through the cutouts to transfer the pattern to the objects.

20 Claims, 3 Drawing Sheets

Z-STAGE CONTROLLER
50
28
PIEZOELECTRIC TRANSDUCER
52
40
48
TRANSDUCER CONTROLLER
POWER SUPPLY
HORN 46
42
44
34
32
20
10
14
36
38
X-Y STAGE CONTROLLER 44
28
20
14
30
54

VIBRATORY MATERIAL REMOVAL SYSTEM AND METHOD

BACKGROUND OF THE INVENTION

1. Field of the Invention

The present invention generally relates to removing material, for example, by machining diverse objects, or by marking and inscribing objects such as gemstones, particularly diamonds, with indicia identifying the gemstones. The material removal is performed by ultrasonically vibrating a liquid mixture of abrasive particles through cutouts in a mask, the cutouts being arranged in a pattern corresponding to the identifying indicia, or in a machining pattern.

2. Description of the Related Art

Laser etching or inscribing of a diamond surface for the purpose of permanently identifying a diamond is well known. U.S. Pat. No. 4,392,476; U.S. Pat. No. 4,467,172; U.S. Pat. No. 5,753,887; U.S. Pat. No. 5,932,119; U.S. Pat. No. 5,149,938; U.S. Pat. No. 5,410,125; U.S. Pat. No. 5,573,684; U.S. Pat. No. 6,211,484 and application Ser. No. 09/785,631 filed Feb. 16, 2001, U.S. Pat. No. 6,483,073, are representative of the prior art of laser marking systems that employ lasers, beam delivery and imaging components, gemstone fixtures, servomotors, optical encoders, and programmed computers for controlling the marking procedure.

Such marking systems not only occupy a large volume of space to accommodate all of their various components, but also are costly to purchase and operate. As a result, such systems are typically installed at one or more authorized sites, such as a gemological laboratory or institute. Jewelers and like customers desiring gemstones to be marked send the gemstones to the site of the marking system, and wait for the marked gemstones to be returned.

Many jewelers dislike sending precious items out of their hands and, hence, out of their sight and control, but perhaps, more importantly, dislike having to wait for their return. Yet, the size and cost of laser marking systems dictate against the average small jeweler's purchasing and installing such a system at the jeweler's premises. Such systems also require skilled, trained personnel to operate the system. This requirement is typically difficult for the average jeweler to meet.

I previously proposed in U.S. patent application Ser. No. 09/858,846, filed May 16, 2001, a flame marking system and method in which a flammable substance filled cutouts in a tape, and was thereupon ignited to scorch a gemstone in a burn pattern corresponding to the cutouts and the indicia to be marked. This technique required close monitoring of the flame produced after ignition to avoid the risk of fire. I also earlier proposed in U.S. patent application Ser. No. 09/909,174, filed Jul. 19, 2001, a gemstone marking system and method in which a radiant energy source caused a fusible coating to be fused on and in the surface of a gemstone in a marking pattern. In one embodiment, the fusible coating filled cutouts in a stencil. The energy source was preferably a laser, but could have been a radio frequency or microwave source. In both of my earlier applications, the marking was achieved at a jeweler's premises.

It is also known to drill or bore holes through or in objects by using a high energy laser, or by ultrasonic drilling especially with brittle objects. The size of the ultrasonic drill bit dictates the size of the hole and, hence, such techniques are unsuitable for complex machining patterns or indicia patterns.

SUMMARY OF THE INVENTION

Objects of the Invention

One object of this invention is to enable gemstones to be marked with identifying indicia without using large sized, costly laser or flame marking systems.

Another object of this invention is to reduce the skill level required for personnel to mark gemstones.

Still another object of this invention is to enable gemstone marking on-site at a jeweler's premises.

Yet another object of this invention is to increase the use of gemstone marking by making the procedure more available and affordable to jewelers.

A further object of this invention is to mark diverse objects, not necessarily a gemstone, in a safe, reliable and permanent manner.

An additional object of this invention is to machine diverse objects with complex machining patterns.

Features of the Invention

In keeping with the above objects and others which will become apparent hereinafter, one feature of the present invention resides, briefly stated, in a vibratory system and method in which an apertured mask is mounted on a surface of an object from which material is to be removed. The mask has cutouts arranged in a pattern. A mixture of a liquid, preferably water, and abrasive particles, such as aluminum oxide, silicon carbide, diamond grit, or mixtures of these and/or other particles, is applied over the mask and fills the cutouts. A vibrator, preferably an ultrasonic piezoelectric transducer, agitates the mixture and propels the abrasive particles through the cutouts against the surface of the object in the pattern corresponding to the cutouts.

In one preferred application, the object is a gemstone, for example, a diamond, and it is desired to mark a surface, such as a table or girdle of the diamond, with identifying indicia. In this application, the pattern of the cutouts in the mask is configured to correspond with the indicia. The marking can be performed at a jeweler's premises. No costly and large-sized machines for directly marking the diamond with a laser beam need be purchased or operated. No flames need be monitored. No costly radiant energy sources are used to fuse coatings at elevated temperatures.

In another application, the pattern of the cutouts is arranged in a machining pattern for objects to be machined. Such objects may include, by way of non-limiting example, microfluidic devices, DNA microarrays (DNA chips), microelectromechanical (MEM) devices, semiconductor wafers, lenses, substrates and, in general, any object to be drilled, cut, shaped or otherwise worked by material removal.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
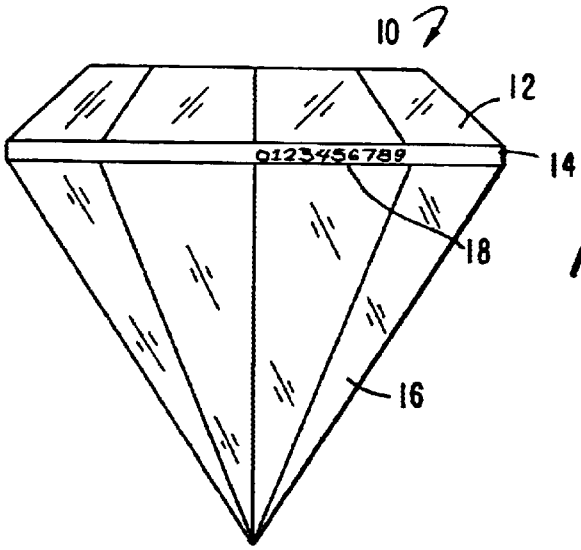
FIG. 1 is a side elevational view of a marked gemstone according to this invention.

Reference numeral 10 in FIG. 1 schematically depicts a diamond having a crown 12, a girdle 14, and a pavilion 16. The girdle 14 is a peripheral band between the crown and the pavilion and, in the preferred embodiment, an identifying indicium or mark 18 is formed on the girdle. The mark 18 can be a machine-readable indicium, such as a one- or a two-dimensional bar code symbol, or can be a human-readable indicium, such as an alphabetical and or numerical indicium, or can be a logo or image, for example, a certification mark of quality or of source of origin. The mark is permanently inscribed and is substantially imperceptible to the naked eye, although clearly visible under magnification such as by a ten power loupe.

Figure 2:
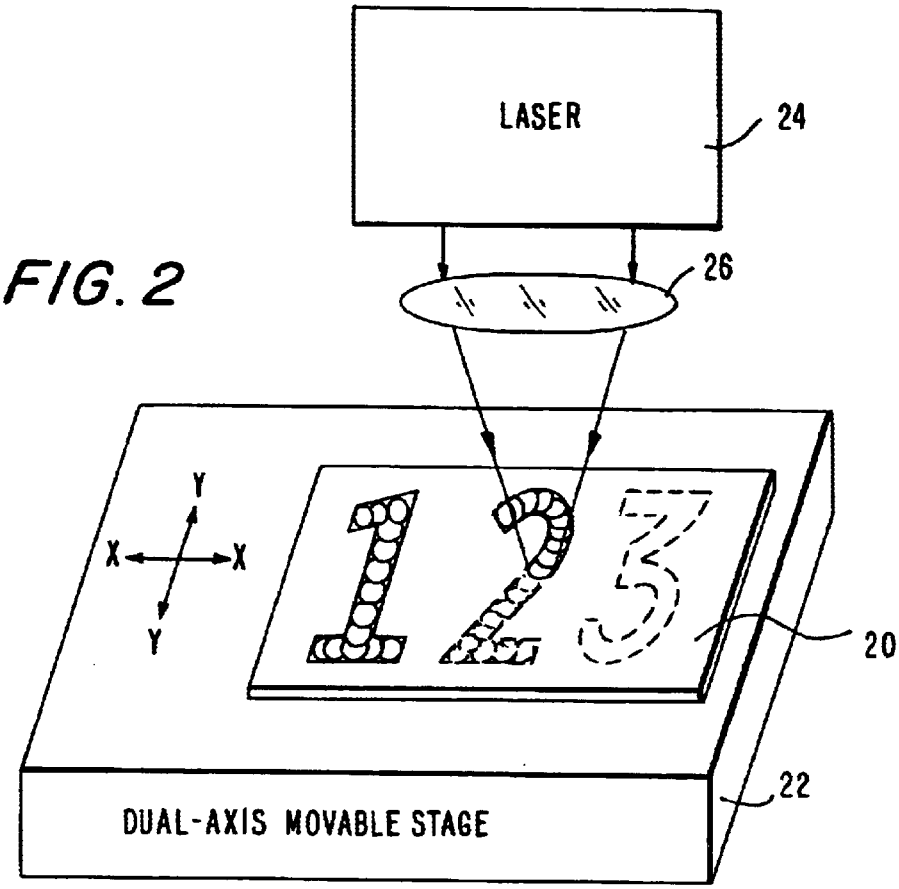
FIG. 2 is a schematic view of a process for making an apertured mask according to this invention.

In accordance with one embodiment of this invention, the mark 18 is formed as follows: First, as depicted in FIG. 2, a generally planar mask 20 is mounted on a table 22 that is independently movable by two DC servomotors along mutually orthogonal directions (X, Y) by microprocessor control. The mask 20 is preferably constituted of a polymer material, or a metal, having a thickness on the order of 1–5 mils, but may be thicker. A bottom side of the mask may bear an adhesive layer.

Next, a laser 24, also under control of the microprocessor, is actuated to direct its laser beam at the mask to form one or more cutouts 30, such as the depicted numerals 1, 2, 3. The laser beam is focused by a lens 26 to form a spot on the mask. The spot burns entirely through the mask. Movement of the mask and the table under microprocessor control relative to the spot causes the spot to form a cutout in the desired shape such as the numerals 1, 2, 3. Numeral 1 is shown in solid lines already formed. Numeral 2 is in the process of being formed. Numeral 3 is shown in dashed lines and is waiting to be formed. Rather than moving the mask, the laser beam may be moved by moving beam-steering mirrors along the mutually orthogonal directions relative to a stationary table.

Instead of forming the indicia in the mask with a laser beam, the cutouts can be formed using other techniques such as photolithographically applying a photoresist, layer and exposing selected portions to light, such as ultraviolet light.

The manufacture of the resulting apertured mask is preferably performed not by the jeweler or ultimate user, but instead, by an authorized mask supplier who has the facilities and equipment to make the mask. Thus, a jeweler may pre-order a supply of apertured masks, for example, with sequential numbers in a series, or with a logo, from the mask supplier.

Figure 4:
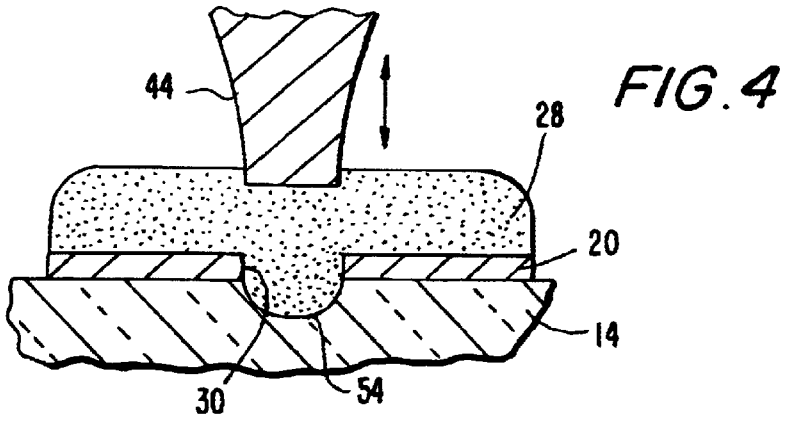
FIG. 4 is an enlarged view of the surface of the gemstone in FIG. 3 during marking.

With the supply of apertured masks on hand at the jeweler's premises, the jeweler selects a mask 20 and applies it, as shown in FIG. 4, along the girdle 14 of a gemstone 10 to be marked. Preferably, the mask has an adhesive surface that adheres to the girdle. The mask need not be adhered to the girdle, but can be applied anywhere on the gemstone, especially on the table or top of the crown 12.

Figure 3:
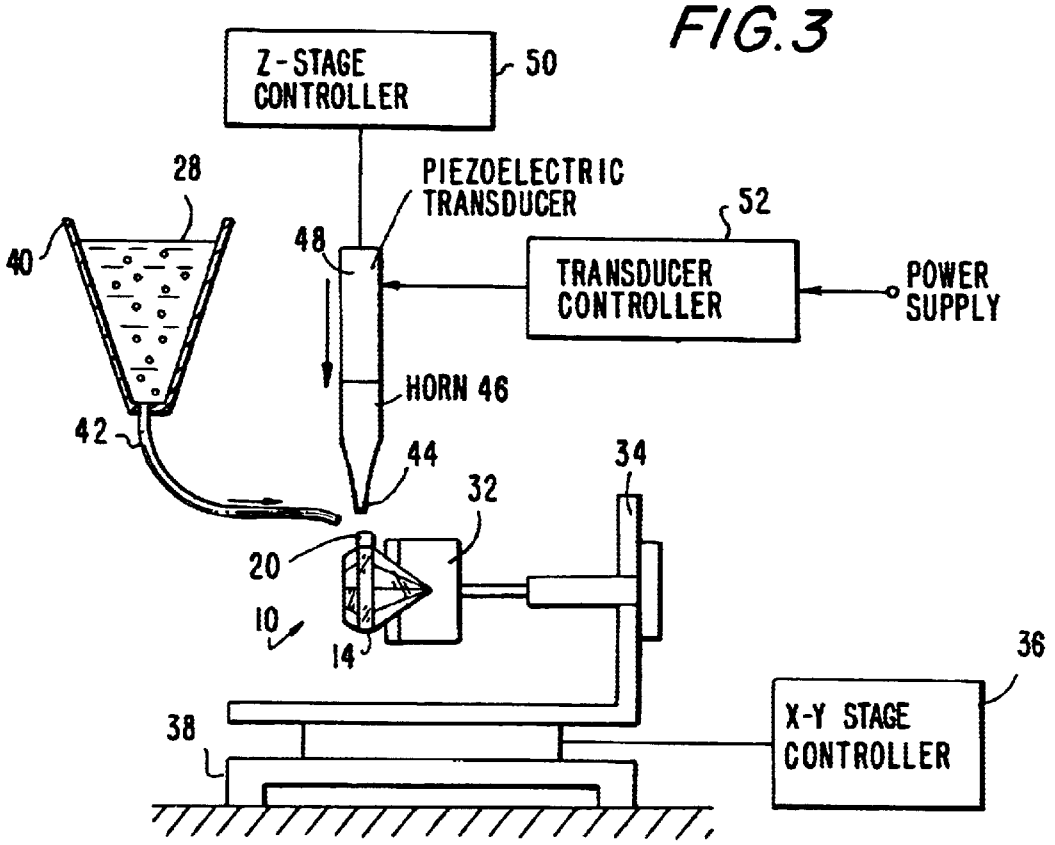
FIG. 3 is an elevational view of a vibratory arrangement for marking a gemstone according to this invention.

As shown in FIG. 3, the diamond 10 is fixedly mounted in a fixture 32 which is, in turn, mounted on a frame 34 that is movable in a horizontal plane along two mutually orthogonal axes by an X-Y stage controller 36, typically a microprocessor that controls two DC servomotors, relative to a stationary support 38.

A reservoir 40 contains a slurry or mixture 28 of a liquid, preferably water, and a multitude of abrasive particles, such as aluminum oxide, silicon carbide, diamond grit, or mixtures thereof, dispersed therein. Each particle is preferably about 1–50 microns in diameter. Other abrasive particles of different shapes, hardnesses and sizes may be employed. The mixture 28 is continuously or batch-wise fed, with the aid of a valve, along delivery hose 42, either by gravity assist or by a pump, toward the area on the girdle 14 to be marked. As shown in FIG. 4, the mixture 28 is shown as a droplet which fills, and is elevated relative to, the cutouts 30 in the mask 20 which is adhered to and along the girdle.

Reference numeral 44 identifies a tip of a horn 46 of a piezoelectric transducer 48. The tip 44 is lowered and immersed into the droplet 28 by a Z-axis controller 50, which is a DC servomotor under microprocessor control. Alternately, the tip 44 can be manually lowered. The tip 44 may contact the mask or, as shown, may be raised above the mask at a distance up to about 500 microns.

A transducer controller 52 applies an electric potential of opposite sign on opposing faces of the transducer 48 to induce a mechanical strain between the opposing faces. The transducer can be a natural crystal, such as quartz, or a synthetic crystal, such as barium titanate. In the preferred embodiment, lead zirconate titanate (PZT) is used. The controller 52 converts a DC voltage from a power supply to an alternating voltage at an ultrasonic frequency, preferably in the range of 20 kHz–130 kHz, which causes the transducer 48 to mechanically vibrate. The vibrations of the transducer are intensified by the horn 46. The tip 44 creates pressure waves in the droplet 28. Specifically, millions of microscopic bubbles (cavities) expand during a negative pressure excursion, and implode violently during a positive pressure excursion. The tip 44 sets up this cavitation in the liquid-borne abrasive particle mixture, causes the molecules in the mixture to become intensely agitated, and propels the abrasive particles through the cutouts 30 against the surface of the diamond.

This invention is not intended to be limited to piezoelectric transducers since other vibrators could equally well be used. For example, magnetorestrictive and electrorestrictive transducers may be employed.

The diamond surface is penetrated as a result of this hammering and battering action. If the surface is hard, as it is in the case:of a diamond, the diamond surface resists, thereby forming a machined bore or a mark 54. If the surface is soft, then a bore or mark is not readily formed because the soft surface absorbs and dampens the vibrations and yields under the battering action.

It is preferred to make the mask of a material softer than a diamond. A soft material mask is preferably only used once and then discarded. However, hard material masks, including masks made of diamond material, could be used for longer wear.

An acceptable mark 54 has been made in a time period of 30 seconds to 2 minutes. The amplitude of vibrations is a finction of the amplitude and frequency of the alternating voltage applied to the transducer, as well as the shape of the horn itself. The controller 52 is preferably provided with controls for adjusting the frequency and amplitude of the alternating voltage. A booster is typically positioned between the horn and the transducer.

The tip 44 wears with prolonged use and, hence, in the preferred embodiment, the tip 44 is designed to be replaceable, typically by threading a rear post on the tip into the horn.

The last step is to remove the mask and clean the gemstone, preferably in an acetone or acid wash. The resulting marked gemstone conforms to that shown in FIG. 1.

The masks can be supplied in various ways. For example, a plurality of masks can be provided in rows and columns on a sheet material, and each mask can be removably peeled therefrom prior to application on the object. In another embodiment, the masks can be successively arranged in a row along a supply reel. In still another technique, the masks can be provided in rows and columns on a master sheet which is then indexed with the object to be marked.

The marking or machining can be performed on any object, and not necessarily on the outer surface of the gemstone, and not necessarily on the girdle. The gemstone need not necessarily be a diamond.

Thus, marking is achieved at a jeweler's premises. The skill involved in applying a mask, then applying the liquid mixture of abrasive particles, then operating the vibrator, and then cleaning the marked gemstone, is well within the expertise of the jeweler. Costly and large-sized machines for directly marking the gemstone with a laser beam are not used.

Figure 5:
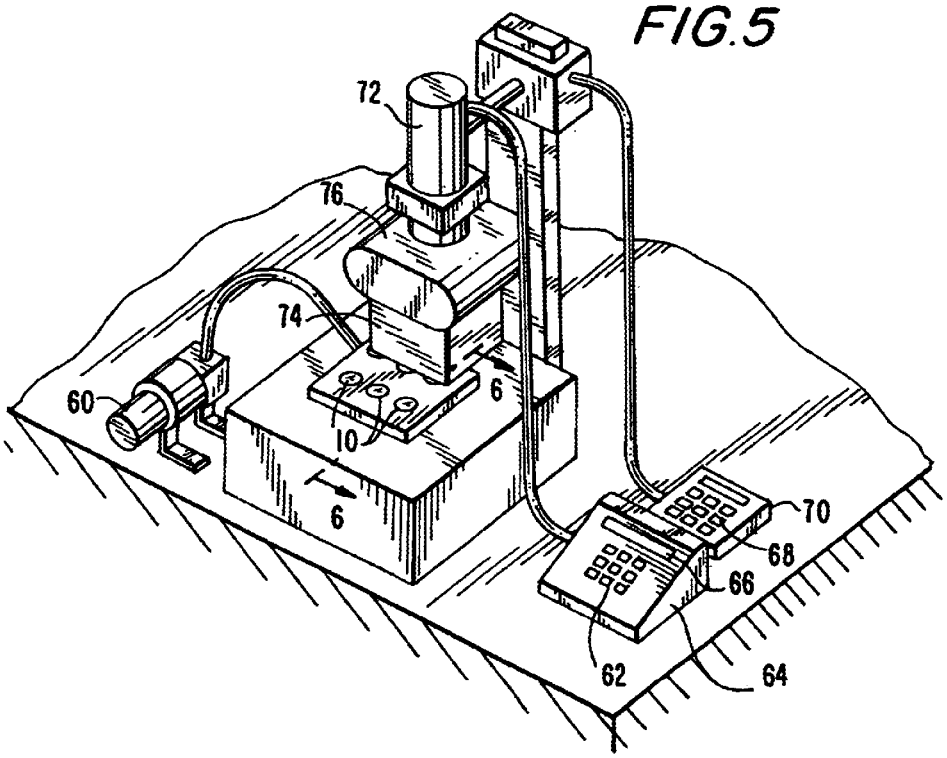
FIG. 5 is a perspective view of another vibratory arrangement for marking or machining multiple gemstones according to this invention.
Figure 6:
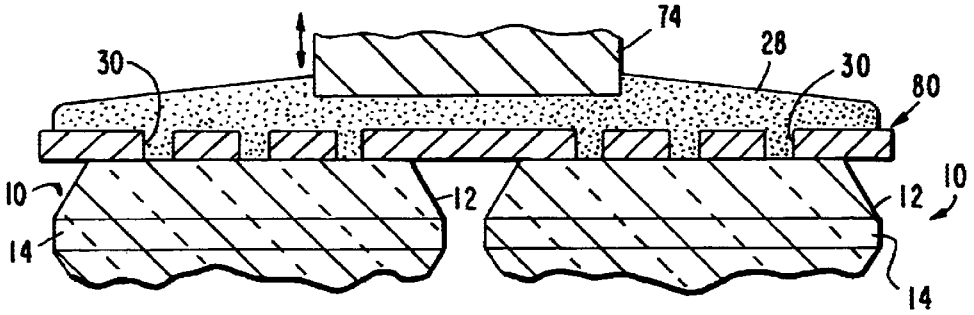
FIG. 6 is an enlarged view taken on line 6—6 of FIG. 5.

FIG. 5 depicts a system analogous to that shown in FIG. 3. A pump 60 is used instead of the reservoir 40 to deliver the mixture 28. A keypad 62 for enabling manual entry of data into a transducer controller 64 is shown, together with a display 66. Another keypad 68 for enabling manual entry of data into a Z-stage controller 70 is depicted. A piezoelectric transducer 72 and its horn 76 are positioned above a workstation at which six objects, for example, diamonds 10, are mounted in two rows. Each diamond 10 is mounted, as best seen in FIG. 6, with its upper flat surface, or table, of the crown 12 facing upwardly toward a tip 74 of the horn 76. In this embodiment, each upper surface is to be marked or machined, rather than the girdle and, in addition, multiple diamonds are to be simultaneously marked or machined, rather than one diamond at a time, with a single tip 74.

Hence, a master mask 80 is placed on all the objects to be marked. The mask 80 is depicted in FIG. 6, but not in FIG. 5, so as not to unduly encumber FIG. 5. A pattern of cutouts 30 is aligned with each object 10, each pattern being either the same (in the case of a logo) or different (in the case of sequential indicia).

With the tip 74 lowered into the mixture 28, and upon actuation of the transducer 72, each pattern is transferred (by machining or marking) as the abrasive particles are propelled through the cutouts as described above. It will be noted that the shape and size of the tip 74 does not dictate the size and shape of each mark or bore formed in the object inasmuch as it is the pattern of the cutouts that determines the configuration of the pattern to be transferred to the object.

It will be understood that each of the elements described above, or two or more together, also may find a useful application in other types of constructions differing from the types described above.

While the invention has been illustrated and described as embodied in a vibratory system and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

I claim:

1. A vibratory system for removing material from an object, comprising:

a) a mask on the object and having cutouts arranged in a pattern;

b) a mixture of a liquid and abrasive particles filling the cutouts; and c) a vibrator for agitating the mixture and propelling the abrasive particles through the cutouts against the object to transfer the pattern to the object.

2. The system of claim 1, wherein the mask includes an adhesive layer.

3. The system of claim 1, wherein the liquid is water.

4. The system of claim 1, wherein the abrasive particles include one of aluminum oxide, silicon carbide, and diamond grit.

5. The system of claim 1, wherein the vibrator includes a piezoelectric transducer.

6. A vibratory marking system for marking an object, comprising:

a) a mask on the object and having cutouts extending through the mask and arranged in a pattern corresponding to indicia to be marked on the object;

b) a mixture of a liquid and abrasive particles filling the cutouts; and c) an ultrasonic vibrator having a tip immersed in the mixture for agitating the mixture and propelling the abrasive particles through the cutouts against the object to transfer the indicia pattern to the object.

7. The marking system of claim 6, wherein the mask includes an adhesive layer.

8. The marking system of claim 6, wherein the liquid is water.

9. The marking system of claim 6, wherein the abrasive particles include one of aluminum oxide, silicon carbide, and diamond grit.

10. The marking system of claim 6, wherein the vibrator includes a piezoelectric transducer.

11. A vibratory method of marking an object, comprising the steps of:

a) forming cutouts in a mask in a pattern corresponding to indicia to be marked on the object;

b) applying the mask on the object;

c) filling the cutouts with a mixture of a liquid and abrasive particles; and d) agitating the mixture and propelling the abrasive particles through the cutouts against the object to transfer the indicia pattern to the object.

12. The method of claim 11; and further comprising the step of adhering the mask to the object.

13. The method of claim 11; and further comprising the step of forming the mixture with water as the liquid, and with one of aluminum oxide, silicon carbide, and diamond grit as the abrasive particles.

14. The method of claim 11, wherein the agitating step is performed by applying an alternating voltage at ultrasonic frequency to a piezoelectric transducer to induce mechanical vibrations in the mixture.

15. The method of claim 14, wherein the agitating step is performed by increasing the vibrations with a horn.

16. The method of claim 15; and further comprising the step of providing the horn with a tip, and the step of immersing the tip into the mixture.

17. The method of claim 11, wherein the filling step is performed by delivering a quantity of the mixture onto the mask.

18. A vibratory machining: system for machining an object, comprising:

a) a mask on the object and having cutouts extending through the mask and arranged in a machining pattern;

b) a mixture of a liquid and abrasive particles filling the cutouts; and c) an ultrasonic vibrator having a tip immersed in the mixture for agitating the mixture and propelling the abrasive particles through the cutouts against the object to transfer the machining pattern to the object.

19. A vibratory method of machining an object, comprising the steps of:

a) forming cutouts in a mask in a machining pattern;

b) applying the mask on the object;

c) filling the cutouts with a mixture of a liquid and abrasive particles; and d) agitating the mixture and propelling the abrasive particles through the cutouts against the object to transfer the machining pattern to the object.

20. A vibratory system for simultaneously removing material from multiple objects, comprising:

a) a mask on the objects and having pluralities of cutouts arranged in pluralities of patterns, each pattern being aligned with a respective object;

b) a mixture of a liquid and abrasive particles filling the pluralities of cutouts; and c) a vibrator for agitating the mixture and propelling the abrasive particles through the pluralities of cutouts against the objects to simultaneously transfer the patterns to the objects.

* * * * *